US007264769B1

(12) United States Patent
Afeltra et al.

(10) Patent No.: US 7,264,769 B1
(45) Date of Patent: Sep. 4, 2007

(54) APPARATUS FOR THE DELIVERY OF MOLTEN METAL

(75) Inventors: Umberto Afeltra, Bussago (IT); Miro Potparic, Duluth, GA (US)

(73) Assignee: Hayes Lemmerz International, Inc., Northville, MI (US)

( * ) Notice: Subject to any disclaimer, the term of this patent is extended or adjusted under 35 U.S.C. 154(b) by 121 days.

(21) Appl. No.: 11/214,689

(22) Filed: Aug. 30, 2005

(51) Int. Cl.
*C21B 3/00* (2006.01)

(52) U.S. Cl. ..... 266/276; 222/604

(58) Field of Classification Search ..... 266/275, 266/276; 222/604
See application file for complete search history.

(56) References Cited

U.S. PATENT DOCUMENTS 3,003,206 A * 10/1961 Peras ..... 222/604
3,226,783 A * 1/1966 Draxler ..... 414/598
4,141,540 A 2/1979 Kroeger et al.
4,144,981 A 3/1979 Borgen
5,967,219 A 10/1999 Lumppio
6,136,064 A 10/2000 Newcomb
6,409,963 B1 6/2002 Gohres et al.
6,488,886 B1 12/2002 Davis
6,513,571 B1 2/2003 Prieto

* cited by examiner

*Primary Examiner*—Scott Kastler
(74) *Attorney, Agent, or Firm*—MacMillan, Sobanski & Todd, LLC

(57) ABSTRACT

An apparatus for the delivery of molten metal includes a container that is pivotably supported by a transportable support structure. An actuator mounted upon the support structure and connected to the container is operable to pivot the container relative to the support structure.

16 Claims, 8 Drawing Sheets

APPARATUS FOR THE DELIVERY OF MOLTEN METAL

BACKGROUND OF THE INVENTION

This invention relates in general to the foundry arts and metallurgy. It is widely known to form articles from metal. One such operation is casting; another is pressure molding. In either operation a metal is chosen from which a final article is to be formed. Next, the metal is heated until it melts into a molten, or liquid, state. Typically, the ingots are melted in a main furnace in a foundry, or metal shop.

A die or mold, in the negative shape of the final article, is provided. The molten metal is then poured, with gravity casting, or injected, with pressure casting, into the die or mold. In gravity casting, the molten metal is allowed to cure, or harden, in the die without additional pressure. In pressure molding, the molten metal is forced into the mold under pressure and/or cured under pressure. The final article is then removed from the die or mold and may or may not be machined. During machining, the article may have extraneous material removed by cutting or any other suitable operation, the surface of the article may be polished to a finished surface, or the article may undergo any other suitable machining operation.

Often a second, or charge, furnace is utilized in the process. The charge furnace receives molten metal from the main furnace and maintains the molten state and/or prepares the molten metal for placement into the die or mold. The charge furnace is typically located near the die or mold. In a large foundry operation with many dies or molds, the foundry may have several charge furnaces, each associated with one die or mold.

Referring to the drawings, there is illustrated in FIGS. 1 and 2 a known arrangement for delivery of molten metal from a main furnace to a charge furnace. As illustrated in FIG. 1, a container, or ladle, 10 is mounted upon a forklift truck 12. The container 10 includes a generally cylindrical main body 14 with a closed bottom 16 and an open top 18. Typically, the container 10 is formed from tempered steel. The container 10 also includes a pair of support ribs 20. The ribs 20 are formed longitudinally, i.e. parallel to the centrally axis of the main body 14, along opposite portions of the main body 14 and extend in a radial direction therefrom. As shown, the ribs 20 are disposed 180 degrees from each other about the circumference of the main body 14. Each rib 20 has at least one tine receiving aperture 22 formed therethrough.

As also illustrated by FIGS. 1 and 2, the forklift truck 12 has a pair of tines 24. The tines are connected to a rotary device (not shown) mounted upon the forklift truck 12 and operable to rotate the tines relative to the truck. The container 10 is transported by the forklift truck 12 by first inserting the tines 24 through the rib apertures 22 and then lifting the container 10.

The container 10 is charged with molten metal 26 from a central furnace 28 by first maneuvering the container 10 below the end of a furnace chute 30. The molten metal is then gravity discharged through the chute 30 from the furnace 28 and into the container 10. The container 10 and the molten metal 26 is then be moved by the forklift truck 12 to a charge furnace 32, which is shown in FIG. 2. At the charge furnace 32, a cover (not shown) over a charging port 33 is opened and one end of a portable transfer chute 34 is inserted into the charging port 33. The forklift truck 12 is then maneuvered to place the container 10 adjacent to the other end of the transfer chute 34. In addition to placement of the forklift truck 12 relative to the transfer chute 34 and the charge furnace 32, the container 10 is usually adjusted in an upward or downward vertical direction, as indicated by the double headed arrow labeled A. As shown in FIG. 2, the container 10 is then rotated relative to the forklift truck 12 by the forklift truck rotary device, as indicated by the arrow labeled B. The molten metal 26 in the container 10 is then discharged under the force of gravity from the container 10 and down the chute 34 into the charge furnace 32. A spout (not shown) is typically formed in the top edge of the container 10 to direct the flow of the molten metal from the container and into the end of the transfer chute 34. The container 10 is then rotated back to its original position relative to the forklift truck and the forklift truck 12 is moved away from the end of the transfer chute 34, allowing removal of the chute and closure of the cover over the furnace charging port.

The maneuvering required to position the container relative to a charge furnace causes a significant amount of turbulence and oxidation in the molten metal 26 during transfer of the molten metal into the charge furnace, thus creating undesired impurities in the final article. Accordingly, it would be desirable to provide an apparatus for the delivery of molten metal that reduces the disturbance of the molten metal.

BRIEF SUMMARY OF THE INVENTION

This invention relates to the foundry arts and more specifically to an apparatus for the delivery of molten metal.

In one aspect of the present invention, an apparatus for the delivery of molten metal includes a container for molten metal that is pivotably mounted upon a transportable support structure. An actuator mounted upon the support structure and connected to the container is operable to pivot the container relative to the support structure. The apparatus is adapted to be carried upon the tines of a forklift truck.

Various objects and advantages of this invention will become apparent to those skilled in the art from the following detailed description, when read in light of the accompanying drawings.

DETAILED DESCRIPTION OF THE PREFERRED EMBODIMENT

Figure 1:
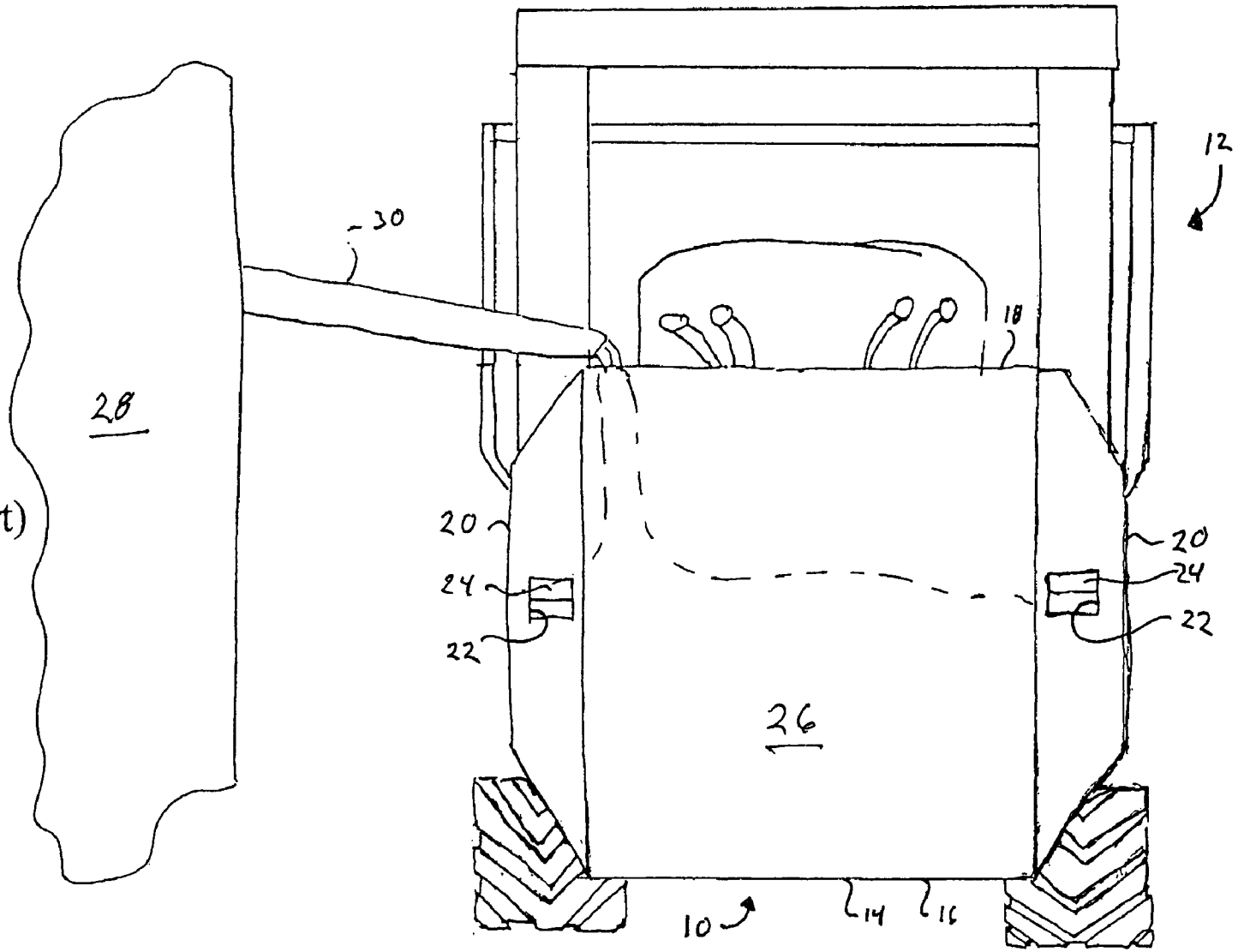
Fig. 1 (Prior Art)
FIG. 1 is a front view of a known container for transporting molten metal, the container shown receiving molten metal from a central furnace.
Figure 2:
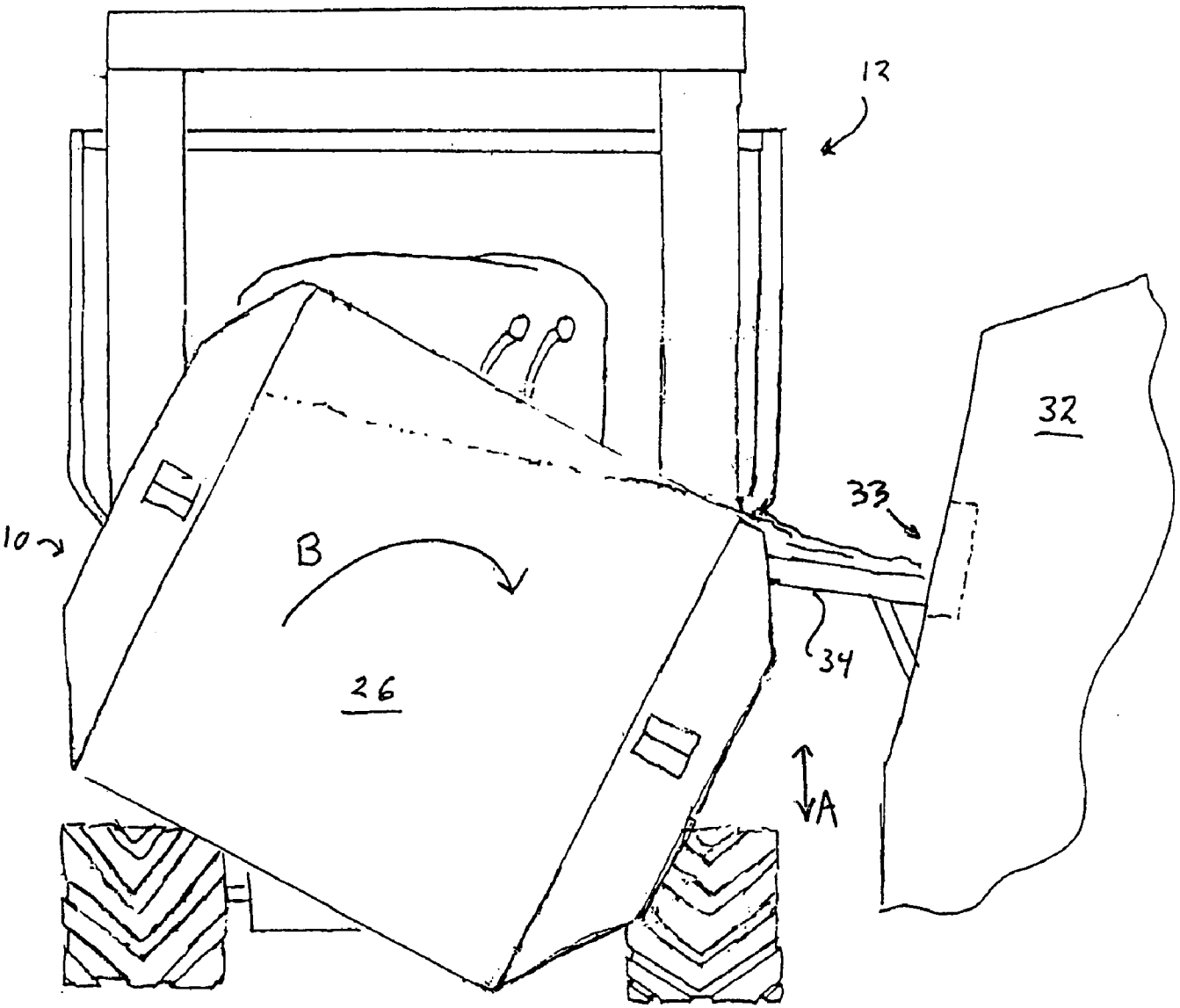
Fig. 2 (Prior Art)
FIG. 2 is a front view of the container of FIG. 1, shown discharging molten metal to a charge furnace.

In the following description of the invention, certain terminology will be used for the purpose of reference only, and is not intended to be limiting. Terms such as "upper", "lower", "above", "below", "rightward", "leftward", "clockwise", and "counterclockwise" refer to directions in the drawings to which reference is made. Terms such as "inward" and "outward" refer to directions toward and away from, respectively, the geometric center of the component described. Terms such as "front", "rear", "side", "leftside", "rightside", "top", "bottom", "horizontal", and "vertical" describe the orientation of portions of the component within a consistent but arbitrary frame of reference which is made clear by reference to the text and the associated drawings describing the component under discussion. Such terminology will include the words specifically mentioned above, derivatives thereof, and words of similar import.

Referring again to the drawings, there is illustrated in FIGS. 3-8 an apparatus 40 for the transport and delivery of molten metal in accordance with the present invention. The apparatus 40 includes a generally cylindrical container 42 in the form of a ladle having a closed bottom 44 and an open top 46. While the container 42 is illustrated in the Figs. as being cylindrical, it will be appreciated that the invention also may be practiced with containers having any suitable shape, such as, for example, frustoconical or semi-spherical.

A primary spout 48 and an auxiliary spout 50, the purpose of which will be described below, extend from the sides of the open top 46. The primary spout 48 has a truncated conical section while the auxiliary spout 50 has a spherical section. However, it must be understood, that the main and auxiliary spouts 48 and 50 may have any suitable shapes, such as, for example, partially cylindrical, wedge shaped, or any other suitable shape. Additionally, while an auxiliary spout 50 is shown in Figs., it will appreciated that the invention also may be practiced with only the primary spout 48.

The container 42 includes a main body portion 52 formed from tempered steel to provide definition to the container 42 while also providing strength and durability. The interior of the container main body portion is 52 lined with a refractory liner portion 54 that is formed from a high refractory chromium oxide material to increase the temperature range of molten metals which are carried by the container 42 while also providing thermal insulation. It must be understood, however, that the main body portion 42 may be made from any suitable material, such as any suitable metal, and that the liner portion 54 may be made from any suitable refractory material that is temperature resistant and insulative. It will also be understood that the container 42 need not have separate main body and the refractory liner portions 52 and 54, but may have a unitary body (not shown) formed from a single appropriate material or the container may be of any other conventional design that is suitable for containing molten metal.

The container 42 includes a pair of pivot arms 56 extending from the main body portion 52, the purpose of which will be described below. The pivot arms 56 are generally planar pieces of steel, having length and height significantly greater than width, although such is not necessary. The arms 56 are located near the main spout 48 and extend in generally the same direction parallel to the sides of the spout. The pivot arms 56 also are located near the open container top 46 and are shown extending thereabove. The pivot arms 56 may be either formed integrally with the main body portion 52 or they may be formed separately and then attached to the container by a conventional method, such as welding. Optional reinforcement members for the arms 56 also may be included such as circumferentially extending flanges 58 that extend from the surface of each of the arms to the side of the container 42. A pivot aperture 56*a* is formed through the outer end of each of the pivot arms 56. Additionally, an actuator attachment aperture 56*b* is formed through the approximate mid portion of each arm 56 and is offset in an inward radial direction from the pivot aperture 56*a*.

The apparatus 40 also includes a transportable support structure 60 that carries the container 42. The support structure 60 includes a generally planar base portion 62. The base portion 62 is designed having a structure of sufficient strength to support the weight of the container 42 and any molten metal 26 contained therein. In the preferred embodiment, the base portion consists of upper and lower steel plates 62*a* and 62*b*, respectively, that are separated by a plurality of sections 62*c* of I-beam. The base portion 62 includes a pair of apertures 64 formed by the spacing of the I-beam sections 62*c* that define tine engagement surfaces 66 and are adapted to receive the tines 24 of the forklift truck 12 and to support the support structure 60 relative to the forklift truck 12. It must be understood, however, that the base portion 62 need not have the apertures 64, but may alternately include any suitable features, such as, for example, channels, whereby the base portion 62 may be carried by or mounted upon the forklift truck 12, or any other suitable vehicle.

Figure 3:
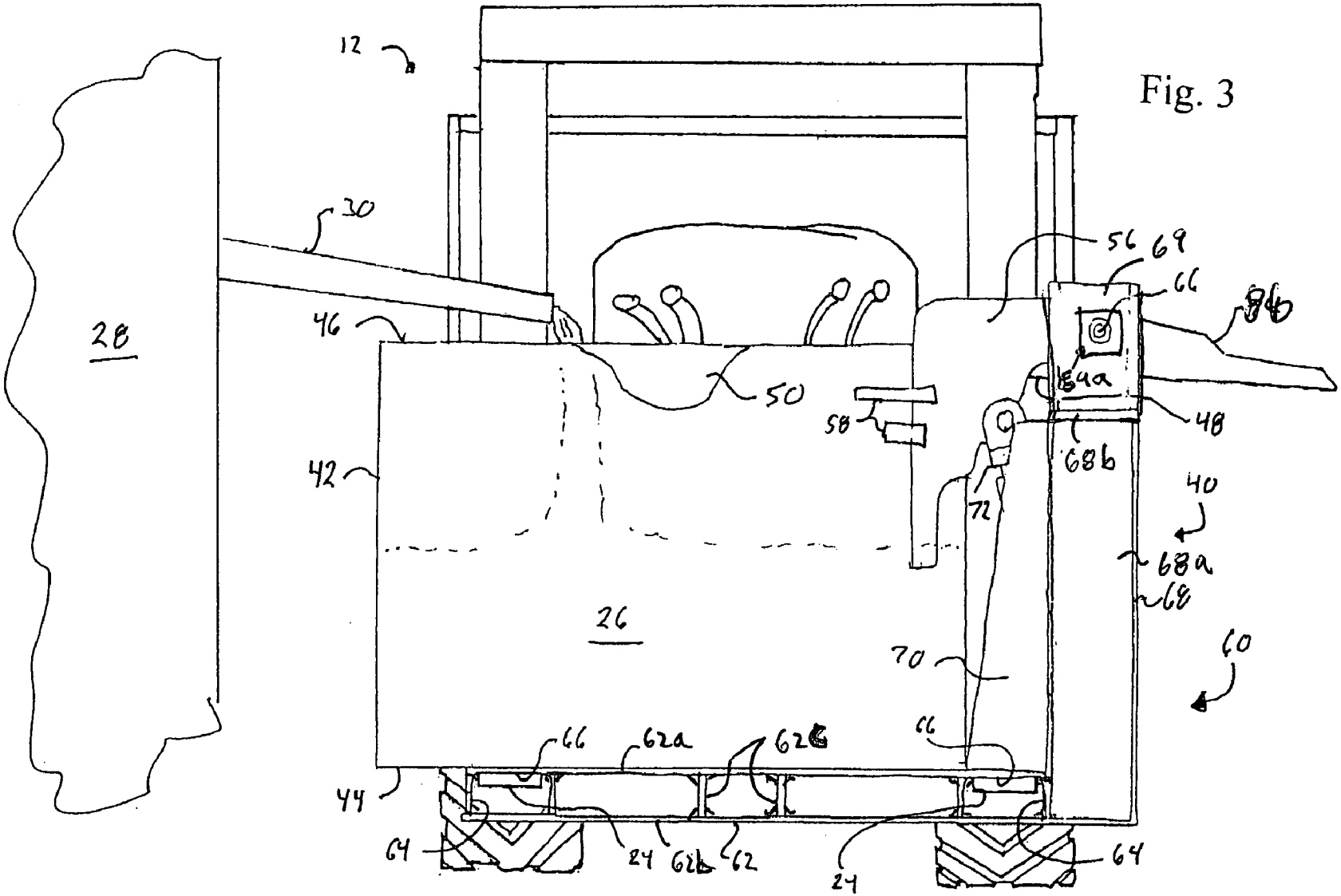
FIG. 3 is a front view of an apparatus for transporting molten metal that is in accordance with the present invention, the apparatus shown receiving molten metal from a central furnace.
Figure 6:
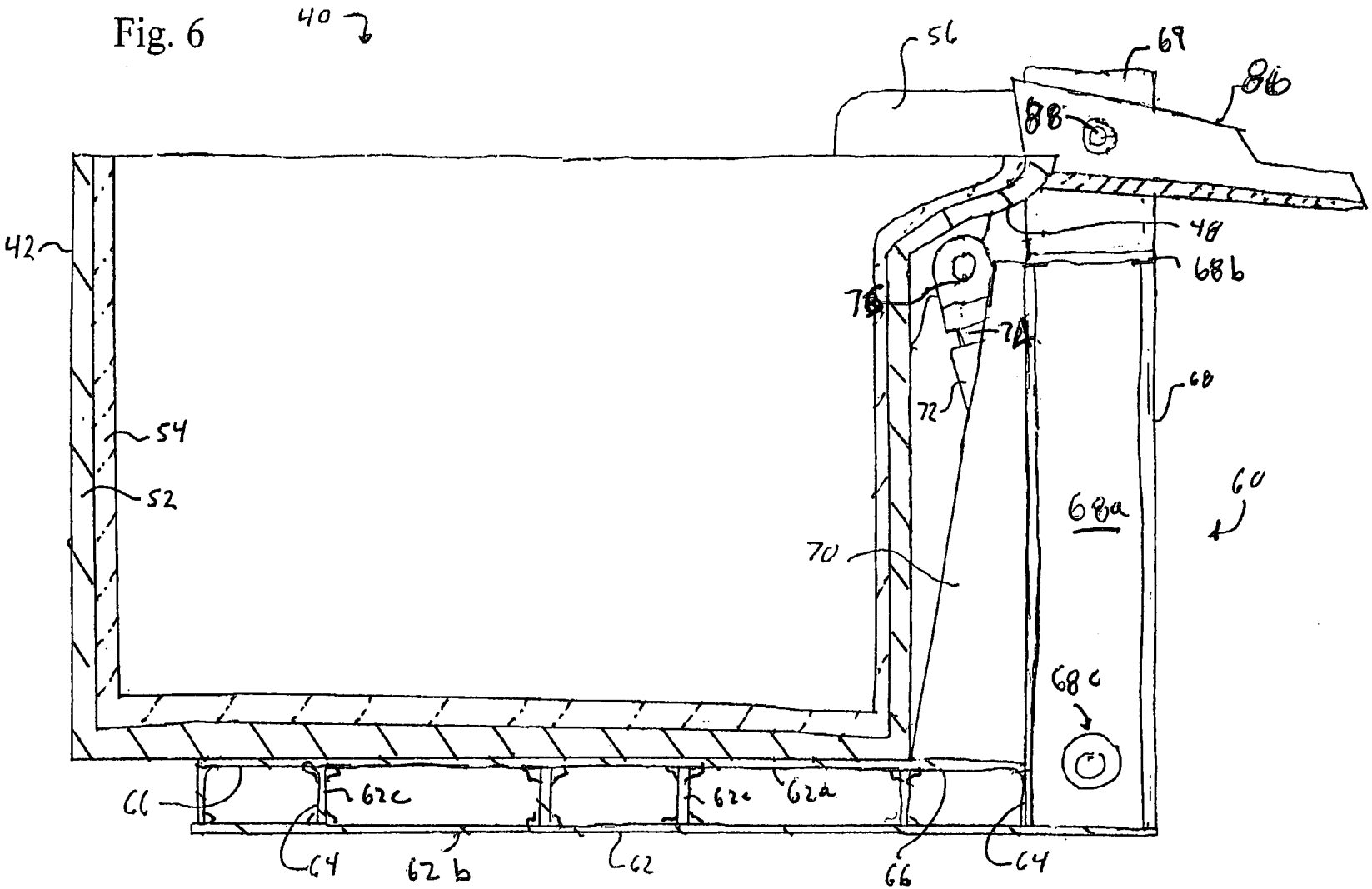
FIG. 6 is a front sectional view of the apparatus of FIG. 4 taken along line 6-6 in FIG. 4.

The apparatus 40 includes a pair of support members 68 that extend in an upward direction from the support base 62 in FIG. 3. In the preferred embodiment, each of the support members 68 includes a pair of spaced apart channel shaped supports 68*a* that are cut from structural steel stock and attached to the base portion 60 with the flanges facing outward from the supports. A cap 68*b* formed from a piece of steel plate is welded to the upper ends of each pair of supports 68*a*. A pair of spaced apart pivot support members 69 extend upward from each of the caps 68*b*. A pivot aperture 69*a* is formed through each of the pivot support members 69 while an actuator attachment aperture 68*c* is formed through the lower end of each of the supports 68*a*. As best seen in FIG. 6, optional reinforcement ribs 70 may be included to provide additional strength to the support members 68. The reinforcement ribs 70 are generally triangularly shaped with one edge fixed to the support member 68 and another edge fixed to the support upper base plate 62*a*. In the preferred embodiment, the ribs 70 are attached to the support members 68 and base plate 62*a* by welding; however, other conventional methods for attachment, such as riveting, bolting, or any other suitable attachment means, also may be utilized.

Figure 4:
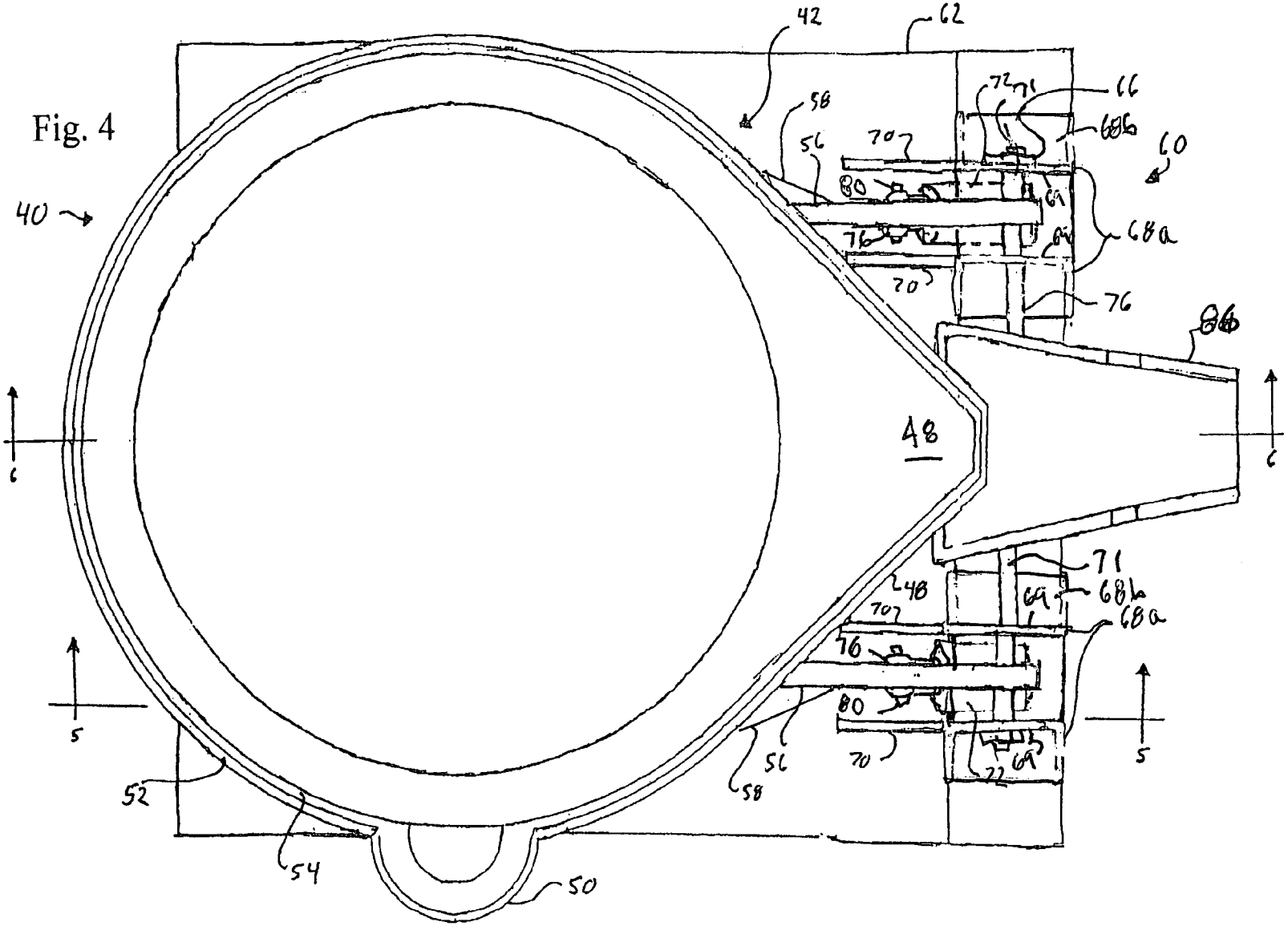
FIG. 4 is a top view of the apparatus of FIG. 3.
Figure 5:
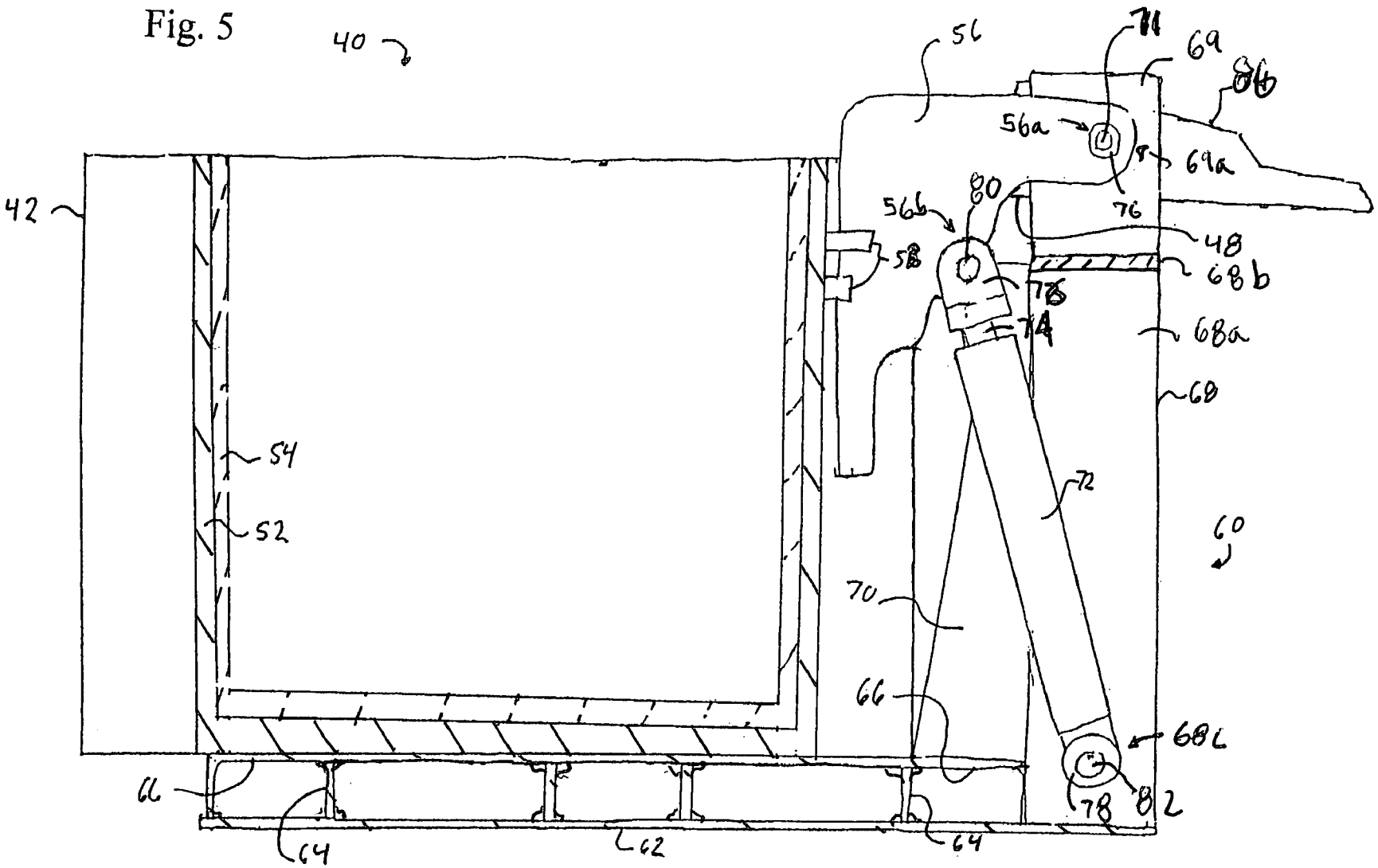
FIG. 5 is a front sectional view of the apparatus of FIG. 4 taken along line 5-5 in FIG. 43.

As best seen in FIG. 4, the container 42 is positioned with each one of the pivot arms 56 extending between and past one of the pairs of pivot support members 69. Additionally, the pivot aperture 56*a* formed in each of the container support arms 56 is aligned with the apertures 69*a* formed through the corresponding pivot support members 69. A container pivot pin 71 extends through each pair of pivot support member apertures 69*a* and the container arm pivot apertures 56*a*. The invention contemplates that either a single pivot pin 71 may extend through both pairs of support member apertures 69*a* and the corresponding container arm pivot apertures 56*a*. Alternately, a pair of pivot pins (not shown) may be utilized, with each pin extending through one pair of support member apertures 69*a* and the corresponding container arm pivot aperture 56*a*. The container 42 is thus pivotably mounted upon the support structure 60. It must be understood, however, that the container 42 may be pivotably mounted upon the support structure 60 in any suitable manner.

The invention also contemplates providing pivot bearings 66 that are mounted upon the pivot support members 69 adjacent to the pivot support apertures 69*a*. Alternately, bearings may be disposed within the container arm pivot apertures 56*a* (not shown). The bearings 66 are operative to reduce the force needed to pivot the container 42 relative to the support structure 60. The pivot pin 71 passes through the bearings 66 and optionally may be secured by spot welding within the non-bearing aperture. Thus, if the bearing 66 is mounted upon the support member 69, as shown in the Figs., the pivot pin 71 may be spot welded to the container arm 56 while, if the bearing 66 is disposed within the container arm pivot aperture 56*a*, the pivot pin 71 may be spot welded to the pivot support member 69. Securing the pivot pin 71 within one of the members prevents the pin from working loose during operation of the apparatus 40.

The apparatus 40 further includes a pair of hydraulic actuators 72 with each of the actuators being disposed between one pair of supports 68*a*. One end of each actuator is pivotably connected to, or mounted upon, the support structure 60. The actuator piston (not shown) is connected by a shaft 74 to a female clevis 76 having a pair of clevis apertures formed therethrough. The lower end of each actuator includes a link 78 having an link aperture formed therethrough. As shown, the clevis 76 attached to the upper end of the actuator is pivotably connected to the container 42 with a clevis pin 80 that extends through the clevis apertures and the container arm actuator attachment aperture 56*b*. Optionally, the clevis pin 80 may be spot welded to either the clevis 76 or the container arm 56 to secure the pin 80 in place. The link 78 on the lower end of the actuator 72 is disposed between the supports 68*a* and is connected thereto with a link connector pin 82 that extends through the actuator link aperture and the support member actuator attachment apertures 68*c*. Again, the ends of each of the link connector pins may be spot welded to the supports 68*a* to secure the pins in place.

In the preferred embodiment, the hydraulic actuators 72 are connected to a controlled source of pressurized hydraulic fluid that is included in the forklift truck 12. Upon the operator opening a pour valve (not shown) that connects the forklift truck supply of pressurized fluid to the lower end of each of the actuators, pressurized hydraulic fluid is supplied to the actuators and urges the actuator pistons in an upward direction in the Figs. Because the actuator attachment apertures 56*b* on the container arms 56 are radially offset from the pivot apertures 56*a*, a rotational torque is generated about the pivot apertures, tipping the container 42. Thus, the actuators are operable to pivot the container 42 relative to the support structure 60. Upon closing the pour vale, the container will be held in position by the pressurized fluid in the actuators 72. Upon the operator opening a release valve that is connected between the lower end of the actuators 72 and a forklift truck fluid reservoir, the pressurized fluid is drained from the actuators 72 and the weight of the container 42 returns the container to its original position upon the support structure 60. Optionally, the actuators 72 may have a self contained source (not shown) of pressurized hydraulic fluid, or the actuators 72 may be supplied pressurized fluid from another available source other than the forklift truck. Additionally, it will be understood that the actuators may be any suitable actuators, to include non-fluid operated actuators, such as a geared arrangement driven by an electric motor, or any other suitable actuator arrangement. Further, it must be understood that the actuators 72 may be connected to the support structure 60 and the container 42 in any suitable location and in any suitable manner.

The apparatus 40 further includes a pivotable spout 86 operable to guide molten metal poured from the container 42 into a charge furnace. In the preferred embodiment, the spout 86 is formed from a steel/refractory composite material. It must be understood, however, that the spout 86 may be formed from any suitable material and in any suitable manner, to include a steel spout with a refractory material lining that is similar to the container 42 described above. The spout 86 is movably mounted upon the support structure 60. As best seen in FIG. 6, the spout 86 is rotatably mounted upon the pivot support members 69 via a pair of spout pins 88 that extend through corresponding apertures formed through the pivot support members 69 and the sides of the spout 86. Alternately, the pivot pin 71 supporting the container 42 upon the support structure 60 may pass through the sides of the spout 86 thereby eliminating the need to form additional apertures through the pivot support members 69. As also shown in FIG. 6, the primary container spout 48 extends into the inner end of the pivotable spout 86 to assure that the molten metal is delivered from the container 42 into the spout 86.

The operation of the apparatus 40 will now be described. As shown in FIG. 3, the apparatus 40 is mounted upon the forklift truck 12 and the container 42 is being charged with molten metal 26 from the central furnace 28 via the furnace chute 30. The forklift truck 12 and the apparatus 40 may alternatively be positioned relative to the central furnace 28 such that the container 42 receives the molten metal 26 from the furnace chute 30 via the auxiliary spout 50, thus reducing the turbulence created during the loading process. The molten metal 26 may then be transported within the container 42 by the forklift truck 12.

Figure 7:
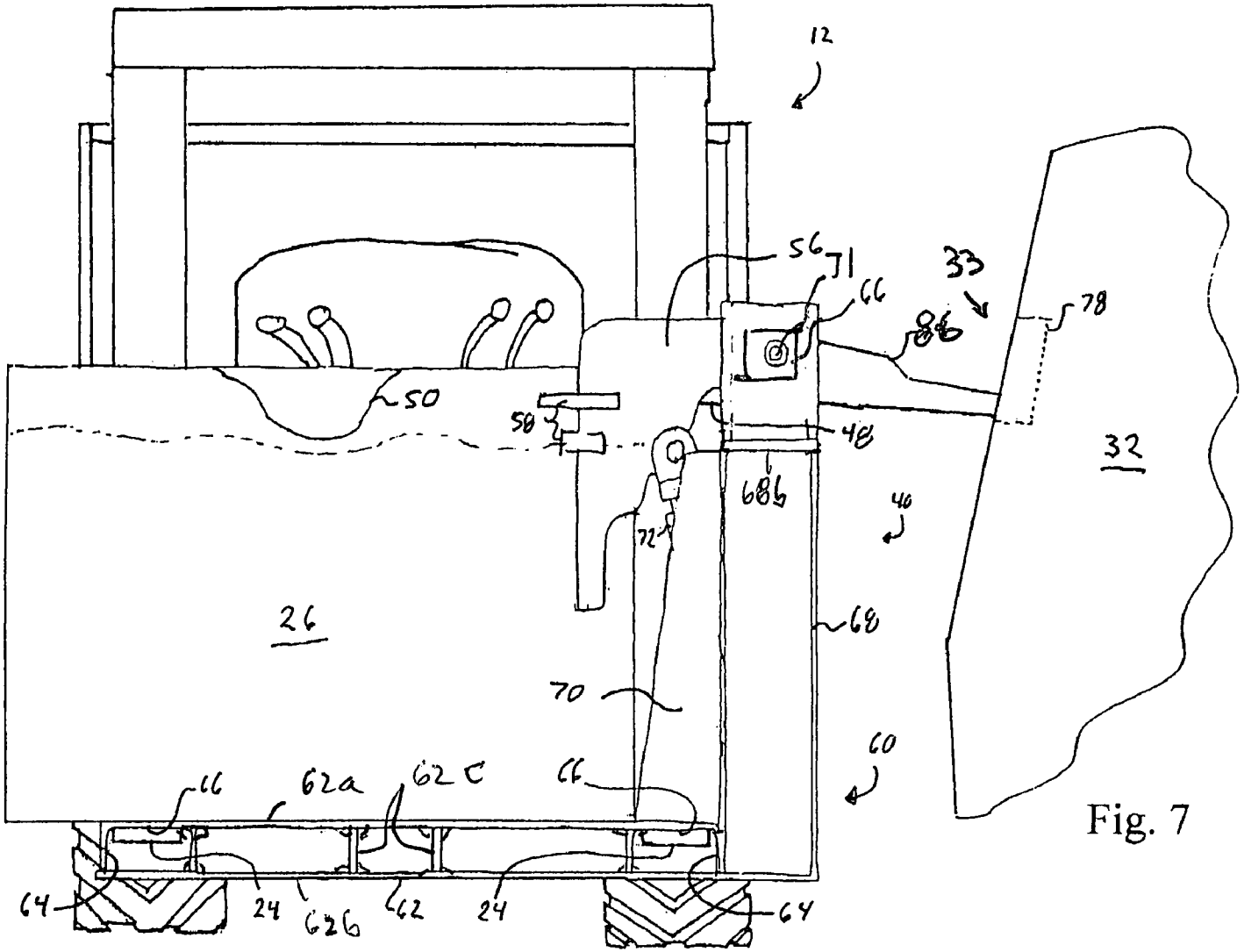
FIG. 7 is a front view of the apparatus of FIG. 4, shown positioned relative to a charge furnace.
Figure 8:
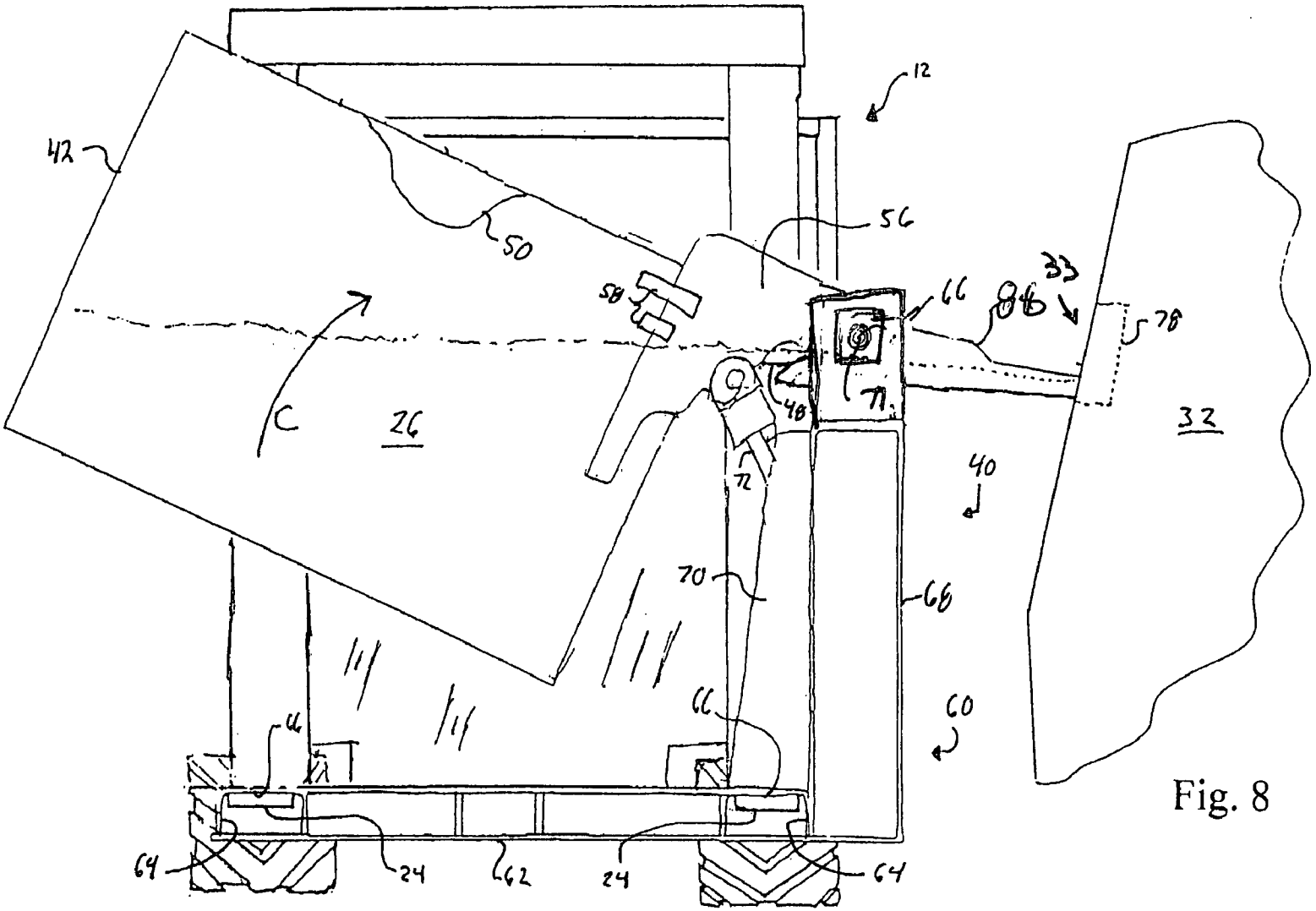
FIG. 8 is a front view of the apparatus of FIG. 4, shown transferring molten metal to the charge furnace.

Discharge of the molten metal into a charge furnace 32 is illustrated in FIGS. 7 and 8. As shown in FIG. 7 the apparatus 40 is first positioned relative to the charge furnace 32 with the spout 86 placed directly into a charging port 33 of the charge furnace 32, thus eliminating the necessity of providing the transfer chute 34. The mobility of the spout 86 relative to the container 42 reduces the maneuvers needed by the forklift truck 12 in order to orient the container 42 relative to the charge furnace 32. Additionally, the elimination of the transfer chute results in time savings.

Once in place, the actuators 72 are activated, by pressurized hydraulic fluid supplied from the hydraulic system of the forklift truck 12. As the actuators 72 extend, the container 42 pivots relative to the support base 60, as indicated by the arrow labeled C, and, as shown in FIG. 8, the container 42 is tipped to discharge molten metal 26 into the charge furnace 32. Once the discharge is completed, the pressurized fluid is released from the actuators 72 allowing the container 42 to pivot back to its original position shown in FIG. 7. The operation of the apparatus 40 reduces the vertical maneuvering of the prior art container 26 shown in FIG. 1 during the discharge of molten metal 26. The reduced maneuvering reduces turbulence during discharge and thereby also reduces oxidation of molten metal 26 during poring. The net result is a reduction of imperfections in the final article. The design of the apparatus 40 also eliminates the need for a rotary lift device rigged to the forklift truck 12.

In the preferred embodiment, the apparatus 40 is used in a facility for casting vehicle wheels with multiple high volume automated casting machines. Each of the casting machines has a dedicated charge furnace that is supplied molten metal from a central refractory furnace by the apparatus 40; however, the invention may also be utilized with machines for casting other metal components than wheels.

While the principle and mode of operation of this invention have been explained and illustrated with regard to particular embodiments, it must be understood, however, that this invention may be practiced otherwise than as specifically explained and illustrated without departing from its spirit or scope.

What is claimed is:

1. An apparatus for the transport and delivery of molten metal, the apparatus comprising:

a container for molten metal;

a transportable support structure sufficient to support said container, said container being pivotably mounted upon said support structure;

a spout movably mounted upon said support structure, said spout operable to guide molten metal poured from said container; and an actuator mounted upon said support structure and connected to said container, said actuator operable to pivot said container relative to said support structure.

2. The apparatus of claim 1 wherein said support structure includes a base having at least one support arm extending therefrom, said container being pivotally mounted upon said support arm.

3. An apparatus for the transport and delivery of molten metal, the apparatus comprising:

a container for molten metal;

a transportable support structure sufficient to support said container, said support structure including a base having at least one support arm extending therefrom, said container being pivotably mounted upon said support arm of said support structure;

a spout movably mounted upon said support structure, said spout operable to guide molten metal poured from said container; and an actuator mounted upon said support structure and connected to said container, said actuator operable to pivot said container relative to said support structure.

4. The apparatus of claim 3 wherein said spout is rotatably mounted upon said support structure.

5. The apparatus of claim 3 wherein said actuator is a hydraulic actuator.

6. The apparatus of claim 5 wherein said support structure base portion is adapted to be one of carried by and mounted upon a vehicle.

7. The apparatus of claim 6 wherein said base portion includes at least one aperture having a tine engagement surface adapted to cooperate with a tine of said vehicle, said tine operable to at least partially support said support structure relative to said vehicle, whereby said base portion may be carried by or mounted upon said vehicle.

8. The apparatus of claim 3 wherein said actuator is a hydraulic actuator and further wherein said actuator is adapted to be connected to a source of pressurized hydraulic fluid that is included in a vehicle for operation of said actuator.

9. The apparatus of claim 8 wherein said power source is a controlled source of pressurized hydraulic fluid.

10. The apparatus of claim 9 wherein said vehicle is a forklift truck.

11. The apparatus of claim 8 wherein said container is a ladle.

12. The apparatus of claim 11 wherein said ladle includes a steel shell with a lining formed from a refractory material.

13. The apparatus of claim 12 wherein said ladle further includes at least one support arm extending from said steel shell.

14. The apparatus of claim 13 wherein said support arm has a pivot aperture formed therethrough and further wherein said ladle support arm also has a pivot aperture formed therethrough that is aligned with said support arm pivot aperture with a pivot pin extending though said pivot apertures, whereby said ladle is pivotable relative to said support arm.

15. The apparatus of claim 14 wherein a bearing is mounted within one of said support arm and ladle support arm apertures with said pivot pin extending through said bearing.

16. The apparatus of claim 13 wherein said support structure includes a pair of extending supports and further wherein said ladle includes a pair of ladle support arms with each of ladle support arms being pivotably supported by a corresponding support.

* * * * *